US011708237B2

(12) United States Patent
Li et al.

(10) Patent No.: US 11,708,237 B2
(45) Date of Patent: Jul. 25, 2023

(54) COMMUNICATION FOR ELEVATOR SERVICE REQUEST

(71) Applicant: Otis Elevator Company, Farmington, CT (US)

(72) Inventors: Kai Li, Shanghai (CN); Haofeng Hou, Shanghai (CN); Fu Qi, Shanghai (CN); SiQi Ma, Shanghai (CN); Hui Chen, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 1127 days.

(21) Appl. No.: 16/393,561

(22) Filed: Apr. 24, 2019

(65) Prior Publication Data

US 2019/0330010 A1 Oct. 31, 2019

(30) Foreign Application Priority Data

Apr. 26, 2018 (CN) ..... 201810384322.9

(51) Int. Cl.
*B66B 1/34* (2006.01)
*B66B 5/00* (2006.01)

(52) U.S. Cl.
CPC ..... *B66B 1/3461* (2013.01); *B66B 5/0025* (2013.01)

(58) Field of Classification Search
CPC ..... B66B 1/34; H04W 4/80
See application file for complete search history.

(56) References Cited

U.S. PATENT DOCUMENTS 6,202,799 B1 * 3/2001 Drop ..... B66B 1/2408 187/391
6,986,408 B2 1/2006 Takeuchi
(Continued)

FOREIGN PATENT DOCUMENTS

CN 106946108 A 7/2017
EP 3141509 A1 3/2017
(Continued)

OTHER PUBLICATIONS

Chinese Office Action for Application No. 201810384322.9; dated Jan. 27, 2022; 13 Pages.
(Continued)

*Primary Examiner* — Wen W Huang
(74) *Attorney, Agent, or Firm* — Cantor Colburn LLP

(57) ABSTRACT

Communication for an elevator service request in the field of elevator technologies. A wireless signal device for broadcasting a wireless signal according to the present invention is capable of communicating with an elevator controller of an elevator system, establishing a wireless connection with a personal mobile terminal based on the wireless signal, receiving an elevator service request command from the personal mobile terminal, and sending the received elevator service request command to the elevator controller for elevator service control. The wireless signal device comprises: an elevator service request command responding unit configured to generate an elevator service request command data packet that has been responded to according to the elevator service request command that has been received; and a broadcasting unit configured to broadcast the elevator service request command data packet that has been responded to.

22 Claims, 3 Drawing Sheets

(56) References Cited

U.S. PATENT DOCUMENTS

| | | | | |
|---|---|---|---|---|
| 9,185,652 | B2 | 11/2015 | Xie et al. | |
| 9,332,376 | B2 | 5/2016 | Knaappila | |
| 9,363,010 | B2 | 6/2016 | Lee et al. | |
| 9,420,407 | B2 | 8/2016 | Jakusovszky et al. | |
| 9,469,500 | B2 | 10/2016 | Friedli | |
| 9,479,892 | B2 | 10/2016 | Knaappila | |
| 9,609,464 | B2 | 3/2017 | Knaappila et al. | |
| 9,668,209 | B1 | 5/2017 | Knaappila | |
| 9,860,688 | B2 | 1/2018 | Kulkarni et al. | |
| 9,878,875 | B1 | 1/2018 | Scoville et al. | |
| 9,892,351 | B2 | 2/2018 | Connolly et al. | |
| 2007/0041352 | A1* | 2/2007 | Frankel | B66B 1/468 370/338 |
| 2012/0048655 | A1* | 3/2012 | Hsu | B66B 1/468 187/247 |
| 2015/0210505 | A1* | 7/2015 | Fujiwara | B66B 1/468 187/381 |
| 2016/0031676 | A1* | 2/2016 | Haipus | B66B 1/468 187/382 |
| 2016/0090270 | A1 | 3/2016 | Wang et al. | |
| 2016/0227392 | A1 | 8/2016 | Palin et al. | |
| 2016/0311647 | A1 | 10/2016 | Peterson et al. | |
| 2017/0034856 | A1 | 2/2017 | Takeuchi et al. | |
| 2017/0073186 | A1 | 3/2017 | Parvianen | |
| 2017/0243417 | A1 | 8/2017 | Manikantan Shila et al. | |
| 2017/0245204 | A1 | 8/2017 | Kumar | |
| 2017/0260023 | A1 | 9/2017 | Zhang | |
| 2017/0260024 | A1* | 9/2017 | Sha | B66B 3/00 |
| 2017/0374629 | A1 | 12/2017 | Ramappa et al. | |
| 2018/0111788 | A1* | 4/2018 | Kim | B66B 1/2408 |
| 2018/0111791 | A1* | 4/2018 | Fang | B66B 1/3461 |
| 2018/0201474 | A1* | 7/2018 | Noxon | H04W 8/005 |
| 2018/0296427 | A1* | 10/2018 | Troesch | G09B 21/003 |
| 2018/0346282 | A1* | 12/2018 | Simcik | B66B 1/3461 |
| 2019/0106290 | A1* | 4/2019 | Chapman | B66B 1/468 |
| 2019/0349724 | A1* | 11/2019 | Chen | H04W 76/10 |
| 2021/0179386 | A1* | 6/2021 | Nowel | A61B 5/1118 |

FOREIGN PATENT DOCUMENTS

| | | | |
|---|---|---|---|
| EP | 3549895 | A2 | 10/2019 |
| GB | 1468061 | A | 3/1977 |
| KR | 20150073440 | A | 7/2015 |
| KR | 101789650 | B1 | 10/2017 |
| WO | 2017024102 | A1 | 2/2017 |

OTHER PUBLICATIONS

Garfield, Leanna, "This app lets you open doors and summon elevators with your phone", Business Insider, May 19, 2016, 10 pages.

Turunen, Hannu et al., "Mobile Interaction with Elevators: Improving People Flow in Complex Buildings", Abstract, Proceedings of International Conference on Making Sense of Converging Media, Oct. 2013, 2 pages.

European Search Report for application EP 19169957.8, dated Feb. 11, 2020, 61 pages.

* cited by examiner

COMMUNICATION FOR ELEVATOR SERVICE REQUEST

FOREIGN PRIORITY

This application claims priority to Chinese Patent Application No. 201810384322.9, filed Apr. 26, 2018, and all the benefits accruing therefrom under 35 U.S.C. § 119, the contents of which in its entirety are herein incorporated by reference.

TECHNICAL FIELD

The present invention relates to the field of elevator technologies, and in particular, to a wireless signal device, and a communication system and method for an elevator service request.

BACKGROUND ART

In order to improve passenger experience, an elevator system is provided with a wireless signal device to interact with a personal mobile terminal carried by a passenger, thus implementing an elevator service request function such as automatic elevator call.

In most cases, each wireless signal device interacts with multiple personal mobile terminals in a "one-to-many" manner

SUMMARY OF THE INVENTION

According to a first aspect of the present invention, a wireless signal device for broadcasting a wireless signal is provided, the wireless signal device being capable of communicating with an elevator controller of an elevator system, establishing a wireless connection with one or more personal mobile terminals based on the wireless signal, receiving an elevator service request command from the personal mobile terminal, and sending the received elevator service request command to the elevator controller for elevator service control, wherein the wireless signal device comprises: an elevator service request command responding unit configured to generate an elevator service request command data packet that has been responded to according to the elevator service request command that has been received; and a broadcasting unit configured to broadcast the elevator service request command data packet that has been responded to.

In the wireless signal device according to an embodiment of the present invention, the elevator service request command responding unit is further configured to generate the elevator service request command data packet that has been responded to according to the elevator service request command that has been received and has been sent to the elevator controller for elevator service control.

In the wireless signal device according to an embodiment of the present invention, the elevator service request command responding unit is further configured to, when an elevator car of the elevator system has completed an action corresponding to a certain service request command data packet that has been responded to, remove the elevator service request command from the elevator service request command data packet that has been responded to.

In the wireless signal device according to an embodiment of the present invention, the wireless signal device is mounted in an elevator car and/or a landing zone.

In the wireless signal device according to an embodiment of the present invention, the elevator service request command is an elevator service request command about an elevator call direction and/or destination floor information.

In the wireless signal device according to an embodiment of the present invention, the wireless signal device is a wireless signal device configured to establish the wireless connection and having a channel capacity less than or equal to 50.

In the wireless signal device according to an embodiment of the present invention, the wireless signal device is a Bluetooth module or a Bluetooth Low Energy module.

According to a second aspect of the present invention, a communication method for an elevator service request is provided, comprising steps of: receiving, by a wireless signal device configured to broadcast a wireless signal, an elevator service request command; generating an elevator service request command data packet that has been responded to according to the elevator service request command that has been received; and broadcasting, by the wireless signal device, the elevator service request command data packet that has been responded to.

In the communication method according to an embodiment of the present invention, in the step of generating an elevator service request command data packet that has been responded to, the elevator service request command data packet that has been responded to is generated according to the elevator service request command that has been received and has been sent to an elevator controller for elevator service control.

In the communication method according to an embodiment of the present invention, in the step of generating the elevator service request command data packet that has been responded to, when an elevator car of an elevator system has completed an action corresponding to a certain service request command data packet that has been responded to, the elevator service request command is removed from the elevator service request command data packet that has been responded to.

In the communication method according to an embodiment of the present invention, the elevator service request command data packet that has been responded to is presented in a list.

According to a third aspect of the present invention, a communication method for an elevator service request is provided, comprising steps of: scanning a wireless signal broadcast by a wireless signal device and identifying the elevator service request command data packet that has been responded to when no connection is established with the wireless signal device; when a to-be-processed elevator service request command is included in the elevator service request command data packet that has been responded to, omitting a step of establishing a wireless connection and sending the to-be-processed elevator service request command The communication method according to an embodiment of the present invention further comprises a step of: when a to-be-processed elevator service request command is not included in the elevator service request command data packet that has been responded to, performing the step of establishing a wireless connection and sending the to-be-processed elevator service request command.

The communication method according to an embodiment of the present invention further comprises a step of: judging whether the to-be-processed elevator service request command is included in the elevator service request command data packet that has been responded to.

The communication method according to an embodiment of the present invention further comprises a step of: still notifying that the to-be-processed elevator service request command has been responded to by the wireless signal device or an elevator system when the step of establishing a wireless connection and sending the to-be-processed elevator service request command is omitted.

According to a fourth aspect of the present invention, a computer readable storage medium storing a computer program thereon is provided, wherein the program is executable by a processor to implement the steps in the communication method as described in any of the foregoing aspects.

According to a fifth aspect of the present invention, a communication system for an elevator service request is provided, comprising an elevator controller configured to perform elevator service control over one or more elevator cars according to all types of elevator service request commands, and further comprising: one or more wireless signal devices as described in any of the foregoing aspects and mounted in the elevator car and/or a landing zone, wherein the communication system is capable of establishing a wireless connection with the wireless signal device through one or more personal mobile terminals and sending a corresponding elevator service request command, and the wireless signal device is capable of communicating with the elevator controller and sending the received elevator service request command to the elevator controller for elevator service control.

In the communication system according to an embodiment of the present invention, when a to-be-processed elevator service request command is included in the elevator service request command data packet that has been responded to, the communication system does not establish, through each of the personal mobile terminals, a wireless connection for sending the to-be-processed elevator service request command.

In the communication system according to an embodiment of the present invention, the communication system scans a wireless signal broadcast by the wireless signal device and identifies the elevator service request command data packet that has been responded to through each of the personal mobile terminals when no connection is established with the wireless signal device.

In the communication system according to an embodiment of the present invention, the communication system judges, through each of the personal mobile terminals, whether the to-be-processed elevator service request command is included in the elevator service request command data packet that has been responded to.

According to a sixth aspect of the present invention, an elevator system is provided, comprising the communication system as described in any of the foregoing aspects.

The above features and operations of the present invention will become more evident according to the following description and accompanying drawings.

BRIEF DESCRIPTION OF THE DRAWINGS

The above and other objectives and advantages of the present invention will become clearer and more complete from the following detailed description of the accompanying drawings. The same or similar elements are represented with the same reference numerals.

DETAILED DESCRIPTION

Figure 1:
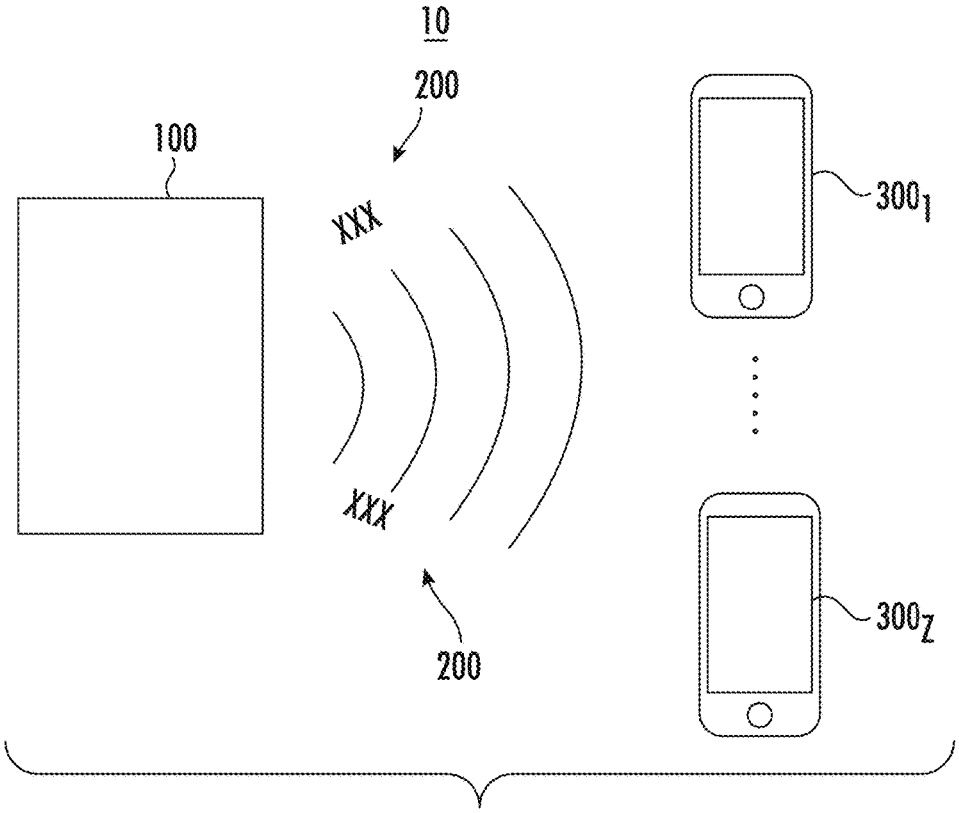
FIG. 1 is a schematic diagram of a communication system for an elevator service request according to an embodiment of the present invention, in which a wireless signal device according to an embodiment of the present invention is provided.

The following is description about exemplary embodiments of the present invention. Examples of these embodiments are shown in the accompanying drawings. Whenever possible, the same reference numerals will be used in all the accompanying drawings to refer to the same or similar parts.

For the purpose of conciseness and illustration, the principles of the present invention are described in this text mainly with reference to its exemplary embodiments. However, it is easy for those skilled in the art to realize that the same principles can be equivalently applied to all types of wireless signal devices, personal mobile terminals, systems that use the wireless signal devices and the personal mobile terminals, and/or their corresponding execution methods, the same principles can be implemented therein, and any such change does not depart from the true spirit and scope of this patent application. Moreover, in the following description, references are made to the accompanying drawings showing specific exemplary embodiments. The embodiments can be electrically, mechanically, logically and structurally modified without departing from the spirit and scope of the present invention. In addition, although the feature of the present invention is disclosed in combination with only one of a number of implementations/embodiments, the feature may be combined with one or more other features of other implementations/embodiments when any given or identifiable function may be expectable and/or advantageous. Therefore, the following description shall not be considered restrictive and the scope of the present invention is defined by the appended claims and their equivalents.

Figure 2:
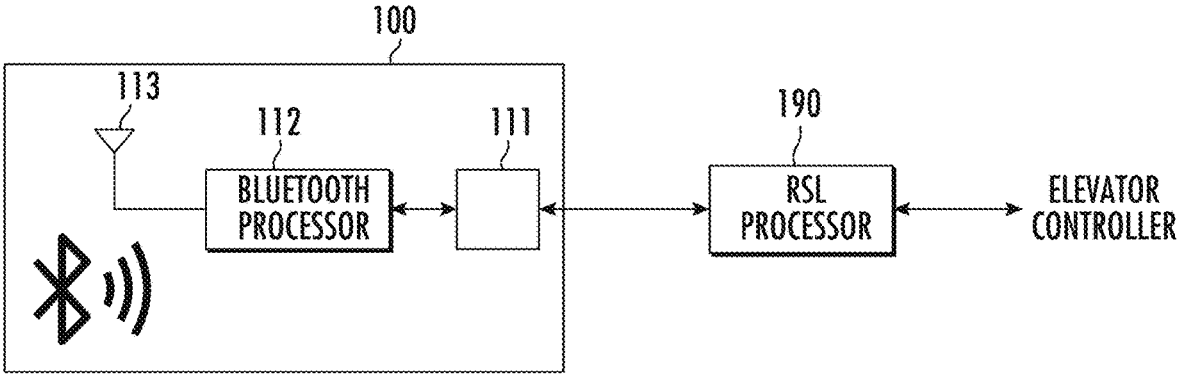
FIG. 2 is a schematic structural diagram of a wireless signal device according to an embodiment of the present invention.
Figure 3:
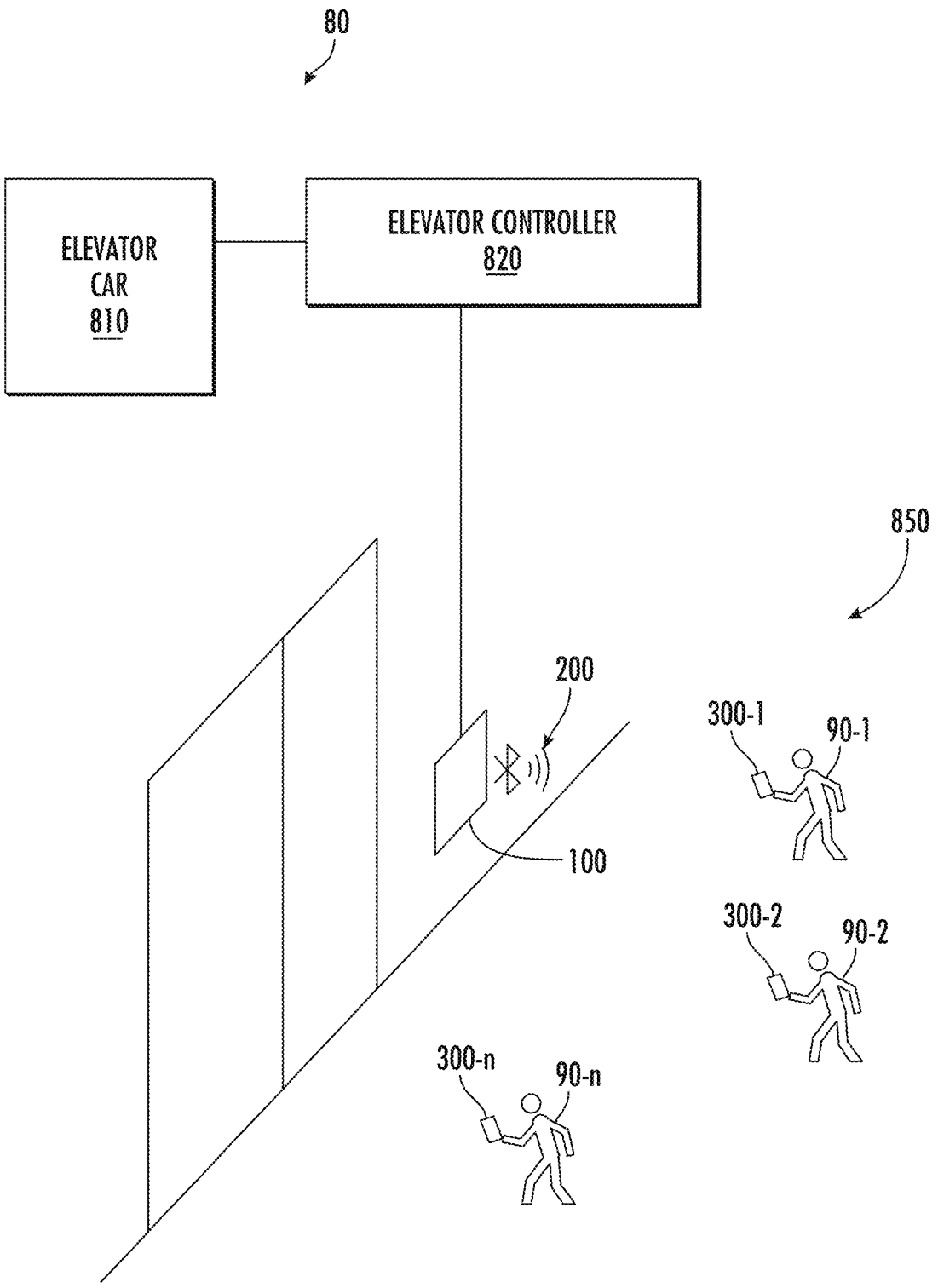
FIG. 3 is a schematic diagram of an application scenario of the communication system according to the embodiment shown in FIG. 1.

FIG. 1 is a schematic diagram of a communication system for an elevator service request according to an embodiment of the present invention, in which a wireless signal device according to an embodiment of the present invention is provided. FIG. 2 is a schematic structural diagram of a wireless signal device according to an embodiment of the present invention. FIG. 3 is a schematic diagram of an application scenario of the communication system according to the embodiment shown in FIG. 1. A wireless signal device, and a communication system and an elevator system that use the wireless signal device according to an embodiment of the present invention are illustrated below through examples with reference to FIG. 1 to FIG. 3.

The communication system 10 as shown in FIG. 1 may be a communication system for an elevator system. For example, it serves as a communication system of an elevator system 80 as shown in FIG. 3 or a part of the communication system. The communication system 10 may be a short-range wireless communication system, which can implement communication interaction between a wireless signal device 100 according to an embodiment of the present invention and a personal mobile terminal 300 according to an embodiment of the present invention, especially communication interaction between the wireless signal device 100 and multiple personal mobile terminals 300 (for example, personal mobile terminals $\mathbf{300}_1$ to $\mathbf{300}_z$) at the same time, so as to automatically complete elevator service requests.

The wireless signal device 100 is also a short-range wireless communication apparatus correspondingly, which may be mounted in an elevator car 810 of the elevator system 80 or mounted in a landing zone 850. For example, it is integrated with an elevator call control panel of the landing zone 850. The wireless signal device 100 may be configured to continuously or intermittently broadcast a wireless signal. By setting signal strength of the broadcast wireless signal, a predetermined area can be covered, and a personal mobile terminal 300 that enters the area can scan or sense the wireless signal.

When scanning or sensing the wireless signal broadcast by the wireless signal device 100 or further meeting a corresponding predetermined condition, the personal mobile terminal 300 automatically generates a to-be-processed elevator service request command, and automatically establishes a wireless connection with the wireless signal device 100 based on various corresponding wireless communication protocols. Through the wireless connection, the personal mobile terminal 300 can automatically send an elevator service request command (i.e., an elevator service request command corresponding to the to-be-processed elevator service request command) to the wireless signal device 100 and then transmit the elevator service request command to the elevator system 80 (for example, an elevator controller 820).

It should be noted that the to-be-processed elevator service request command is a command that reflects a current elevator service demand of a passenger 90. "To-be-processed" indicates that the personal mobile terminal 300 may further need to perform a corresponding processing action on the elevator service request command after the to-be-processed elevator service request command is generated. For example, a processing action of sending the elevator service request command to the wireless signal device 100 may further be included. However, in the present invention, the to-be-processed elevator service request command is not necessarily actually sent to the wireless signal device 100 (which will be described below). For example, when the condition changes, a processing action performed by the personal mobile terminal 300 on the to-be-processed elevator service request command changes, and thus the processing action of sending the to-be-processed elevator service request command to the wireless signal device 100 is no longer needed.

The wireless signal device 100 may correspondingly respond to the receiving of the elevator service request command For example, the wireless signal device 100 determines that the elevator service request command has been received and transmits the elevator service request command to the elevator controller 820 of the elevator system 80 for elevator service control. Based on at least one of the above responses, the wireless signal device 100 determines the received elevator service request command as an elevator service request command data packet 200 that has been responded to (which is, for example, represented with "xxx" as shown in FIG. 1). In an embodiment, based on the established wireless connection, the wireless signal device 100 can feed information indicating successful sending of the response back to the corresponding personal mobile terminal 300. Thus, the passenger 90 using the personal mobile terminal 300 is notified that the elevator service request command sent by him/her has been responded to successfully, and the passenger 90 will wait for an elevator car 810 to be scheduled in, for example, the landing zone 850.

In an embodiment, when another apparatus configured to input an elevator service request command (for example, an elevator call control panel capable of receiving a manual elevator service request command) is further mounted in the elevator system 80, for example, a "run upward" elevator service request command manually input by the passenger which will also be naturally transmitted to the elevator controller 820, the wireless signal device 100 can also determine the received elevator service request command as an elevator service request command data packet 200 that has been responded to. Therefore, the elevator service request command data packet that has been responded to does not necessarily correspond to the elevator service request command from the personal mobile terminal 300.

The applicant noticed that when the communication system 10 is applied to the elevator system 90, each wireless signal device 100 actually serves multiple personal mobile terminals 300 in a "one-to-many" manner in many cases. However, for example, the number n of the personal mobile terminals 300 that enter the coverage of the wireless signal broadcast by the wireless signal device 100 is uncontrollable, and dynamically changes completely according to the number of the passengers 90 carrying the wireless signal devices 100. For example, in the application scenario as shown in FIG. 3, n (n is an integer greater than or equal to 2) passengers 90 enter the landing zone 850 to take an elevator basically at the same time, and n personal mobile terminals 300 will establish wireless connections with, for example, one wireless signal device 100 to send their respective elevator service request commands This has a relatively high requirement for the channel capacity of the wireless signal device 100 for establishing a wireless connection (hereinafter referred to as "connection channel capacity"). Especially when n is greater than the connection channel capacity of the wireless signal device 100, some personal mobile terminals 300 will be incapable of timely establishing wireless connections with the wireless signal device 100 and sending corresponding elevator service request commands, that is, "traffic congestion" will occur. Therefore, on the one hand, the passenger experience in terms of an automatic elevator service request will be reduced, and on the other hand, the corresponding processing workload of the wireless signal device 100 will be increased.

The above problem becomes more prominent in the wireless signal device 100 with the smaller connection channel capacity of wireless connection. For example, it becomes more noticeable in the wireless signal device 100 with the connection channel capacity less than or equal to 50. Alternatively, for example, in the wireless signal device 100 with a Bluetooth module, its connection channel capacity is difficult to meet the requirement that more than dozens of passengers 90 are wirelessly connected to the Bluetooth module basically at the same time.

In an embodiment, while broadcasting the wireless signal, the wireless signal device 100 according to the present invention further broadcasts the elevator service request command data packet 200 that it has responded to. The elevator service request command data packet 200 that has been responded to may refer to an elevator service request command data packet 200 that has been responded to currently by the wireless signal device 100. If the elevator car 810 of the elevator system 80 has completed an action corresponding to a certain elevator service request command (for example, complete an action of scheduling and stopping), the elevator service request command is no longer regarded as the elevator service request command data packet 200 that has been responded to and is no longer broadcast. Therefore, the broadcast elevator service request command data packet 200 that has been responded to is actually dynamically updated according to the running of the elevator car 810 and/or the elevator service request command sent by the personal mobile terminal 300.

For example, if the personal mobile terminal 300 sends a "run upward" elevator service request command, the wireless signal device 100 determines to receive the elevator service request command and transmits the elevator service request command to the elevator controller 820, thus completing a response to the elevator service request command The elevator service request command is classified as the elevator service request command data packet 200 that has been responded to. Once a correspondingly assigned elevator car 810 stops at the floor and runs upward, which indicates that an action corresponding to the elevator service request command has been completed, the elevator service request command is removed from the elevator service request command data packet 200 that has been responded to. At the same time, it should be understood that other elevator service request commands continuously serve as the elevator service request command data packet 200 that has been responded to when the elevator car 810 has not completed actions corresponding to the other elevator service request commands In an embodiment, the elevator service request command 200 that has been responded to may be a set of multiple elevator service request commands, which may be presented in a list. The elevator service request command sent by the personal mobile terminal 300 may be an elevator service request command about an elevator call direction (for example, "run upward" or "run downward"), or an elevator service request command about a destination floor (for example, "Floor M") (i.e., a destination floor registration command), or an elevator service request command about an elevator call direction and destination floor information. Correspondingly, the elevator service request command 200 that has been responded to may be an elevator service request command about an elevator call direction (for example, "run upward" or "run downward"), or an elevator service request command about a destination floor (for example, "Floor M") (i.e., a destination floor registration command), or an elevator service request command about an elevator call direction and destination floor information, or their combination.

It is to be appreciated that in the embodiment in which the wireless signal device 100 is mounted to the elevator car 810, the elevator service request command sent by the personal mobile terminal 300 is an elevator service request command about a destination floor (for example, "Floor M") (i.e., a destination floor registration command), and the elevator service request command 200 that has been responded to by the wireless signal device 100 is also an elevator service request command about a destination floor (i.e., a destination floor registration command). Once the elevator car 810 arrives at a floor corresponding to an elevator service request command, the elevator service request command will be removed from the elevator service request command data packet 200 that has been responded to.

In an embodiment, as shown in FIG. 2 and FIG. 3, the wireless signal device 100 can establish a communication connection with the elevator controller 820 of the elevator system through, for example, a Remote Serial Link (RSL) processor, thus transmitting the received elevator service request command to the elevator controller 820.

Still referring to FIG. 1, once entering the corresponding coverage of the wireless signal, the personal mobile terminal 300 can scan the wireless signal broadcast by the wireless signal device 100 and identify the elevator service request command data packet 200 that has been responded to when no connection is established between the personal mobile terminal 300 and the wireless signal device 100. The personal mobile terminal 300 is further configured to generate a to-be-processed elevator service request command when scanning or sensing the wireless signal broadcast by the wireless signal device 100. Further, the personal mobile terminal 300 compares the to-be-processed elevator service request command with the scanned and identified elevator service request command 200 that has been responded to, thus judging whether the to-be-processed elevator service request command is included in the elevator service request command data packet 200 that has been responded to. If the judgment is "Yes" (for example, the to-be-processed elevator service request command is the same as one command in the elevator service request command data packet 200 that has been responded to), it indicates that the elevator service request command the same as the to-be-processed elevator service request command 300 has been successfully responded to by the elevator system 10 or the wireless signal device 100, and the personal mobile terminal 300 does not needs to send the to-be-processed elevator service request command once again. Therefore, the personal mobile terminal 300 will send an instruction to itself to omit the process of establishing a wireless connection and sending the to-be-processed elevator service request command If the judgment is "No" (for example, the to-be-processed elevator service request command is different from any command in the elevator service request command data packet 200 that has been responded to), it indicates that the to-be-processed elevator service request command 300 is not successfully responded to by the elevator system 10 or the wireless signal device 100 currently, and the personal mobile terminal 300 needs to send the to-be-processed elevator service request command to the wireless signal device 100 once again. Therefore, the personal mobile terminal 300 will send an instruction to itself to perform the process of establishing a wireless connection and sending the to-be-processed elevator service request command.

In the communication system 10 according to the above embodiment, as the elevator service request command 20 that has been responded to is sent by broadcasting, this can be implemented through a few (such as less than 3) broadcast channels for broadcasting. Moreover, each personal mobile terminal 300 can know the elevator service request command 200 that has been responded to by the wireless signal device 100 when no connection is established between the personal mobile terminal 300 and the corresponding wireless signal device 100, and there is no need to occupy the connection channel capacity of the wireless signal device 100. In other words, once the personal mobile terminal 300 can scan the wireless signal, it can automatically know the elevator service request command 200 that has been responded to. Besides, in some cases, some personal mobile terminals 300 do not need to establish a wireless connection for the to-be-processed elevator service request command, thus greatly reducing the demand for the connection channel capacity and also greatly reducing the workload of the wireless signal device 100 while well solving the problem of "traffic congestion".

It should be noted that when the wireless signal device 100 is mounted to the landing zone 850 and the elevator service request command is an elevator service request command about an elevator call direction (for example, "run upward" or "run downward"), the volume of data of the elevator service request command 200 that has been responded to is small as there are basically two types of elevator service request commands The to-be-processed elevator service request command is also prone to be the same as one command in the elevator service request command data packet 200 that has been responded to. Therefore, this can better avoid unnecessary wireless connections, better reduce the demand for the connection channel capacity of the wireless signal device 100 and better solve the problem of "traffic congestion." In other words, the above effects are more obvious.

In an embodiment, the wireless signal device 100 is a Bluetooth module that can broadcast a Bluetooth signal, and is specifically, for example, a Bluetooth Low Energy (BLE) module. Correspondingly, the wireless communication unit of the personal mobile terminal 300 is selectively set as a Bluetooth communication module. The Bluetooth communication module and the Bluetooth module can conduct Bluetooth interactive communication based on, for example, a Bluetooth 4.0 protocol. As the connection channel capacity of the Bluetooth module is relatively limited (for example, less than 37), the communication system 10 according to the above embodiment has more prominent effects when the wireless signal device 100 is a Bluetooth module.

Specifically, in the embodiment as shown in FIG. 2, the wireless signal device 100 is a Bluetooth module, which is provided with an elevator service request command responding unit 111, a Bluetooth processor 112, and an antenna 113.

The Bluetooth processor 112 can be configured to control the antenna 113 to broadcast a Bluetooth signal and Bluetooth data of the elevator service request command data packet 200 that has been responded to. Therefore, the Bluetooth processor 112 and the antenna 113 can jointly form a broadcasting unit configured to broadcast the elevator service request command data packet 200 that has been responded to in the wireless signal device 100. Moreover, the Bluetooth processor 112 can further control establishment of a wireless connection with the personal mobile terminal 300 in response to a request from the personal mobile terminal 300. In an embodiment, the Bluetooth processor 112 can, for example, complete a response of determining to receive each elevator service request command 200.

The elevator service request command responding unit 111 is configured to generate the elevator service request command data packet 200 that has been responded to at least according to the elevator service request command that has been received. For example, the elevator service request command data packet 200 that has been responded to can be generated by editing, in a list, the elevator service request commands that have been determined to be received from the last stopping and leaving of the elevator car 810 to the present time. It should be noted that in another alternative embodiment, the elevator service request command responding unit 111 may also be disposed in the Bluetooth processor 112 or implemented by the Bluetooth processor 112.

In an embodiment, the elevator service request command responding unit 111 may be further configured to, when an elevator car of the elevator system has completed an action corresponding to a certain service request command data packet that has been responded to, remove the elevator service request command from the elevator service request command data packet 200 that has been responded to. As such, the elevator service request command data packet 200 that has been responded to is dynamically updated according to the action of the elevator car to guarantee the accuracy of the current elevator service request command data packet 200 that has been responded to.

It should be noted that even if the wireless signal device can further receive an elevator service request command the same as one command in the elevator service request command data packet 200 that has been responded to, the elevator service request command responding unit 111 will not update the elevator service request command data packet 200 that has been responded to based on the received elevator service request command Specifically, the elevator service request command responding unit 111 may also remove the received elevator service request command from the wireless signal device 100 to avoid redundantly sending the elevator service request command to the elevator controller.

In an embodiment, as shown in FIG. 2, specifically, the elevator service request command responding unit 111 can establish a communication connection with the elevator controller of the elevator system through, for example, an RSL processor 190, thus can conveniently send the received elevator service request command to the elevator controller, and definitely can also conveniently receive other information from the elevator system 80.

It should be understood that the specific type of the wireless signal device 100 is not limited to the Bluetooth module in the above embodiment. For example, the wireless signal device 100 may also be other types of wireless signal devices such as a Wifi module, or other wireless signal devices similar to the Bluetooth module which are known by those skilled in the art, e.g., an infrared module. In an embodiment, the wireless signal device 100 may be a wireless signal device having the connection channel capacity less than or equal to 50.

The wireless signal device 100, the communication system 10 and the elevator system 80 according to the present invention are further illustrated through examples below with reference to the scenario shown in FIG. 3.

In the elevator system 80 according to an embodiment, as shown in FIG. 3, the wireless signal device 100 according to the present invention in the embodiment as shown in FIG. 1 is mounted in the landing zone 850 of the elevator system 80. The wireless signal device 100 may be a BLE module (for example, integrated with an elevator call control panel), which can broadcast a Bluetooth signal to at least cover the landing zone 850. The wireless signal device 100 can establish a Bluetooth connection with the personal mobile terminal 300 based on the broadcast Bluetooth signal and receive, when establishing the Bluetooth connection, an elevator service request command about an elevator call direction (for example, "run upward" or "run downward") sent from the personal mobile terminal 300, so that the passenger 90 carrying the personal mobile terminal 300 can complete an elevator call request in a hand-free manner when approaching or entering the landing zone 850. That is, the elevator call operation can be completed without manual input or registration on the elevator call control panel in the landing zone 850 or manual operation on the personal mobile terminal 300.

As shown in FIG. 3, after the elevator car 810 runs upward to leave the floor where the elevator landing zone 850 is located, if the passenger 90-1 first arrives at the elevator landing zone 850 and becomes the first passenger sending a "run upward" elevator service request command, the wireless signal device 100 will receive the "run upward" elevator service request command and successfully make a response, for example, transmit the elevator service request command to the elevator controller 820. At this point, the elevator service request command responding unit 111 of the wireless signal device 100 will generate an elevator service request command data packet 200 that has been responded to, including the "run upward" elevator service request command. If any of the following passengers 90-2 to **90-*n* arrives at the elevator landing zone 850 and a to-be-processed elevator service request command generated through the personal mobile terminal 300 (for example, one of the personal mobile terminals marked as 300-2 to 300-*n*) carried by the passenger is also a "run upward" elevator service request command, any of the personal mobile terminals 300-2 to 300-*n* will be capable of determining that the "run upward" elevator service request command is included in the elevator service request command data packet 200 that has been responded to. In other words, any of the personal mobile terminals 300-2 to 300-*n* will be capable of intelligently realizing that the to-be-processed elevator service request command generated by it has actually been successfully responded to by the wireless signal module 100 or the elevator system 80, and the wireless signal module 100 does not need to redundantly receive the elevator service request command Therefore, any of the personal mobile terminals 300-2 to 300-*n* can cancel establishment of a wireless connection with the wireless signal module 100, thereby canceling sending of the "run upward" elevator service request command. As such, the burden of wireless connections of the wireless signal module 100 is reduced, and the problem of "traffic congestion" will not easily occur even if n is greater than or even far greater than the connection channel capacity of the wireless signal module 100**.

Figure 4:
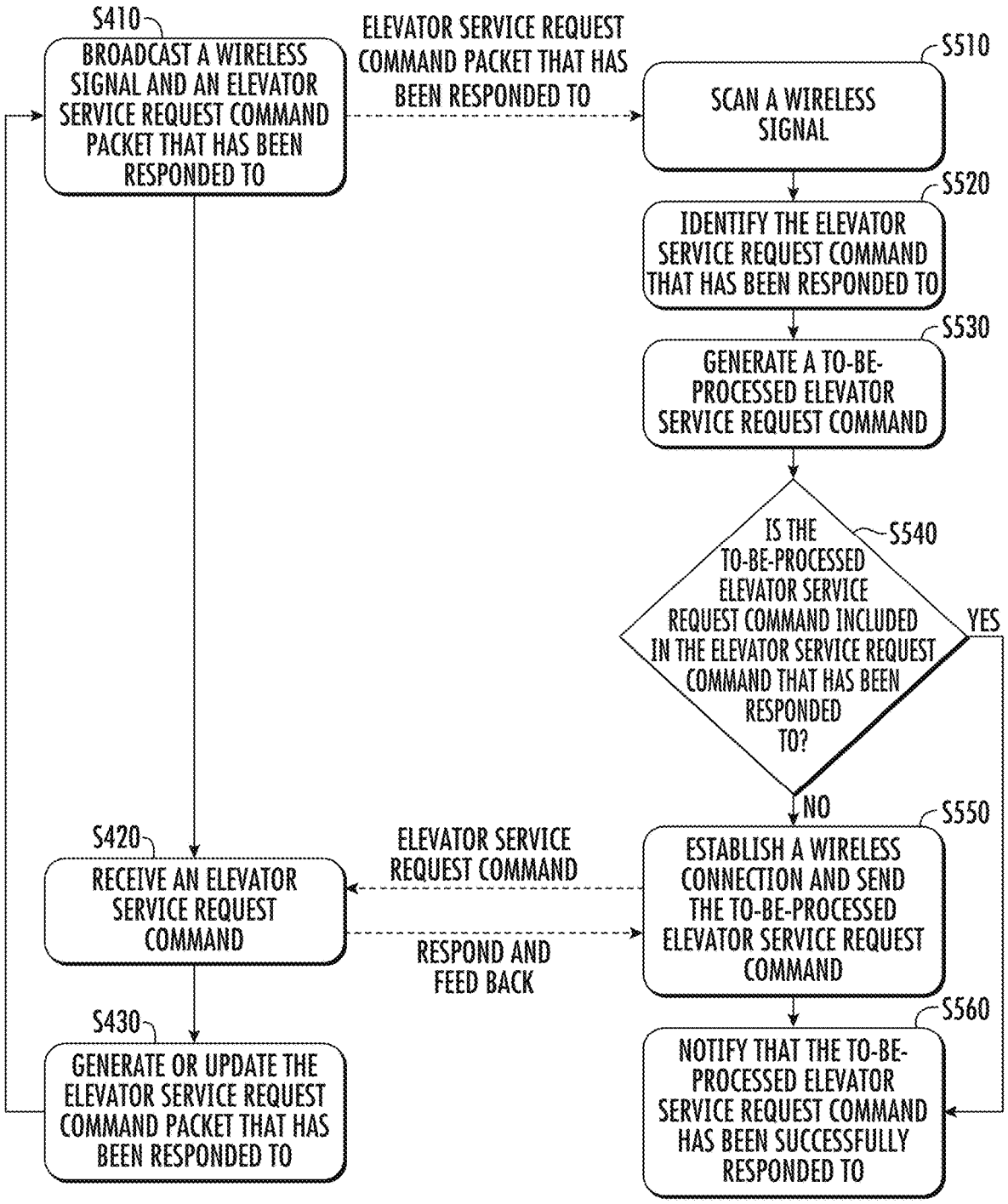
FIG. 4 is a flowchart of a communication method for an elevator service request according to an embodiment of the present invention.

A communication method for an elevator service request according to an embodiment of the present invention is illustrated below through examples with reference to FIG. 3 and FIG. 4. Step S410 to step S430 are basically performed in the wireless signal device 100, and step S510 to step S560 are basically performed through the personal mobile terminal 300.

In step S410, a wireless signal is broadcast and an elevator service request command data packet 200 that has been responded to is also broadcast. The elevator service request command data packet 200 that has been responded to, which is generated in step S430, may dynamically change, so the elevator service request command data packet 200 that has been responded to, which is broadcast in this step, may also dynamically change. It should be appreciated that step S430 may be continuously performed, so as to continuously broadcast the elevator service request command data packet 200 that has been responded to.

Correspondingly, in step S510, the wireless signal broadcast by the wireless signal device 100 is scanned and identified.

In step S530, the elevator service request command data packet 200 that has been responded to is identified when no connection (such as a Bluetooth connection) is established with the wireless signal device 100. It should be appreciated that the dynamically changed elevator service request command data packet 200 that has been responded to can be identified dynamically, thus identifying the latest elevator service request command data packet 200 that has been responded to. As such, the personal mobile terminal 300 can rapidly and conveniently acquire the latest elevator service request command data packet 200 that has been responded to.

At the same time, in step S530, a to-be-processed elevator service request command is generated for the passenger 90. It should be noted that the specific method of generating the to-be-processed elevator service request command is not limited.

In step S540, it is judged whether the to-be-processed elevator service request command is included in the elevator service request command data packet 200 that has been responded to. For example, the above judging process can be completed by comparing the to-be-processed elevator service request command with any command in the elevator service request command data packet 200 that has been responded to and judging whether they are the same.

If the judgment is "Yes," it indicates that the to-be-processed elevator service request command is redundant for the wireless signal device 100, the step of establishing a wireless connection and sending the to-be-processed elevator service request command (for example, step S550) is omitted, and an instruction is directly sent to notify that the to-be-processed elevator service request command has been responded to by the wireless signal device 100 or the elevator system 80, i.e., step S560 is performed.

If the judgment is "No," step S550 is performed to establish a wireless connection and send the to-be-processed elevator service request command. Correspondingly, step S420 is performed at the side of the wireless signal device 100. The wireless signal device 100 establishes a wireless connection with the personal mobile terminal 300 in response, so as to receive an elevator service request command. The elevator service request command may be an elevator service request command from a personal mobile terminal 300. In an embodiment, when the elevator service request command is determined to be received, it indicates that the wireless signal device 100 completes a response to the elevator service request command Definitely, the response of the wireless signal device 100 can be indicated until the elevator controller 820 completes an operation of responding to the elevator service request command. When receiving the elevator service request command, the wireless signal device 100 can feed information about response success back to the personal mobile terminal 300 that establishes a wireless connection with the wireless signal device 100. Correspondingly, the personal mobile terminal 300 performs step S560 to notify that the to-be-processed elevator service request command has been responded to by the wireless signal device 100 or the elevator system 80.

In step S430, the elevator service request command data packet 200 that has been responded to is generated or updated. For example, the elevator service request command data packet 200 that has been responded to can be generated by editing, in a list, the elevator service request commands that have been determined to be received from the last stopping and leaving of the elevator car 810 to the present time. The generating process may be a dynamic updating process. For example, the elevator service request command data packet 200 that has been responded to is dynamically updated according to the running of the elevator car 810 and/or the elevator service request command sent by the personal mobile terminal 300.

The elevator service request command data packet 200 that has been responded to, which is generated or updated in step S430, is broadcast in step S410.

It should be appreciated that the communication method of the above step S510 to step S550 can be performed in each of the multiple personal mobile terminals 300 or repeated in each personal mobile terminal 300.

In the communication method for an elevator service request according to the above embodiment, a corresponding elevator car can still be scheduled for the passenger 90 to provide an elevator service even if the step of establishing a wireless connection and sending the to-be-processed elevator service request command is omitted or canceled. Moreover, the possibility of occupying the connection channel capacity or connection capacity between the personal mobile terminal and the wireless signal device is reduced. The problem of "traffic congestion" will not easily occur even if the channel capacity of the wireless signal device 100 is small. At the same time, the number of elevator service request commands received and processed by the wireless signal device 100 is also reduced, and the workload of the wireless signal device 100 is reduced correspondingly.

It is to be appreciated that in the flowcharts and/or block diagrams of the method, the system and the device according to the embodiments of the present application, the description in the flowcharts and/or each block in the block diagrams and combinations of the description in the flowcharts and/or the block diagrams can be implemented by computer program instructions. The computer program instructions may be provided to a general-purpose computer, a special-purpose computer, or a processor of other programmable data processing equipment to constitute a machine, such that the instructions executed by the computer or the processor of the other programmable data processing equipment create a component configured to implement functions/operations designated in the flowcharts and/or blocks and/or one or more block flowcharts.

The computer program instructions may be stored in a computer readable memory. The instructions can instruct the computer or another programmable data processor to implement functions in a specific manner, such that the instructions stored in the computer readable memory constitute an article of manufacture including an instruction component configured to implement functions/operations designated in one or more blocks of the flowcharts and/or block diagrams.

The computer program instructions may be loaded onto the computer or another programmable data processor to execute a series of operation steps on the computer or another programmable data processor to generate processes implemented by the computer, so that the instructions executed on the computer or another programmable data processor provide steps for implementing functions or operations designated in one or more blocks of the flowcharts and/or the block diagrams. It should be further noted that in some alternative implementations, the functions/operations shown in the blocks may not take place according to the sequence shown in the flowchart. For example, two blocks shown sequentially may be performed substantially at the same time, or these blocks sometimes may be performed in a reversed order, which specifically depends on the functions/operations involved.

The foregoing description is exemplary and are not defined to be limitative. Various non-limitative implementation solutions are disclosed in this text. However, according to the foregoing teaching, those of ordinary skill in the art will be aware that various modifications and variations will fall within the scope of the appended claims. Therefore, it should be appreciated that the disclosure content other than those specifically disclosed can be implemented within the scope of the appended claims. Therefore, the appended claims should be read up to determine the real scope and content.

What is claimed is:

1. A wireless signal device for broadcasting a wireless signal, capable of communicating with an elevator controller of an elevator system, establishing a wireless connection with one or more personal mobile terminals based on the wireless signal, receiving an elevator service request command from the personal mobile terminal, and sending the received elevator service request command to the elevator controller for elevator service control, wherein the wireless signal device comprises:

an elevator service request command responding unit configured to generate an elevator service request command data packet that has been responded to according to the elevator service request command that has been received; and a broadcasting unit configured to broadcast to the one or more personal mobile terminals the elevator service request command data packet that has been responded to.

2. The wireless signal device of claim 1, wherein the elevator service request command responding unit is further configured to generate the elevator service request command data packet that has been responded to according to the elevator service request command that has been received and has been sent to the elevator controller for elevator service control.

3. The wireless signal device of claim 1, wherein the elevator service request command responding unit is further configured to, when an elevator car of the elevator system has completed an action corresponding to a certain service request command data packet that has been responded to, remove the elevator service request command from the elevator service request command data packet that has been responded to.

4. The wireless signal device of claim 1, wherein the wireless signal device is mounted in an elevator car and/or a landing zone.

5. The wireless signal device of claim 1, wherein the elevator service request command is an elevator service request command about an elevator call direction and/or destination floor information.

6. The wireless signal device of claim 1, wherein the wireless signal device is a wireless signal device configured to establish the wireless connection and having a channel capacity less than or equal to 50.

7. The wireless signal device of claim 1, wherein the wireless signal device is a Bluetooth module or a Bluetooth Low Energy module.

8. A communication system for an elevator service request, comprising an elevator controller configured to perform elevator service control over one or more elevator cars according to all types of elevator service request commands, the communication system comprising:

one or more wireless signal devices of claim 1 mounted in the elevator car and/or a landing zone, wherein the communication system is capable of establishing a wireless connection with the wireless signal device through one or more personal mobile terminals and sending a corresponding elevator service request command, and the wireless signal device is capable of communicating with the elevator controller and sending the received elevator service request command to the elevator controller for elevator service control.

9. The communication system of claim 8, wherein when a to-be-processed elevator service request command is comprised in the elevator service request command data packet that has been responded to, the communication system does not establish, through each of the personal mobile terminals, a wireless connection for sending the to-be-processed elevator service request command.

10. The communication system of claim 9, wherein the communication system scans a wireless signal broadcast by the wireless signal device and identifies the elevator service request command data packet that has been responded to through each of the personal mobile terminals when no connection is established with the wireless signal device.

11. The communication system of claim 9, wherein the communication system judges, through each of the personal mobile terminals, whether the to-be-processed elevator service request command is comprised in the elevator service request command data packet that has been responded to.

12. An elevator system, comprising the communication system of claim 8.

13. The wireless signal device of claim 1, wherein the broadcasting unit is configured to broadcast to a plurality of personal mobile terminals the elevator service request command data packet that has been responded to.

14. A communication method for an elevator service request, comprising:

receiving, by a wireless signal device configured to broadcast a wireless signal, an elevator service request command;

generating an elevator service request command data packet that has been responded to according to the elevator service request command that has been received; and broadcasting to one or more personal mobile terminals, by the wireless signal device, the elevator service request command data packet that has been responded to.

15. The communication method of claim 14, wherein in generating an elevator service request command data packet that has been responded to, the elevator service request command data packet that has been responded to is generated according to the elevator service request command that has been received and has been sent to the elevator controller for elevator service control.

16. The communication method of claim 14, wherein in the generating the elevator service request command data packet that has been responded to, when an elevator car of an elevator system has completed an action corresponding to a certain service request command data packet that has been responded to, the elevator service request command is removed from the elevator service request command data packet that has been responded to.

17. The communication method of claim 14, wherein the elevator service request command data packet that has been responded to is presented in a list.

18. A communication method for an elevator service request, comprising:

scanning a wireless signal broadcast by a wireless signal device and identifying the elevator service request command data packet that has been responded to when no connection is established with the wireless signal device;

when a to-be-processed elevator service request command is comprised in the elevator service request command data packet that has been responded to, omitting a step of establishing a wireless connection and sending the to-be-processed elevator service request command.

19. The communication method of claim 18, further comprising:

when a to-be-processed elevator service request command is not comprised in the elevator service request command data packet that has been responded to, performing the step of establishing a wireless connection and sending the to-be-processed elevator service request command.

20. The communication method of claim 18, further comprising:

judging whether the to-be-processed elevator service request command is comprised in the elevator service request command data packet that has been responded to.

21. The communication method of claim 18, further comprising:

still notifying that the to-be-processed elevator service request command has been responded to by the wireless signal device or an elevator system when the step of establishing a wireless connection and sending the to-be-processed elevator service request command is omitted.

22. A computer readable storage medium, storing a computer program thereon, wherein the program is executable by a processor to implement the steps in the method of claim 18.

* * * * *